US012429246B2

(12) United States Patent
Sun et al.

(10) Patent No.: US 12,429,246 B2
(45) Date of Patent: Sep. 30, 2025

(54) OUTDOOR UNIT OF AIRCONDITIONER

(71) Applicant: SAMSUNG ELECTRONICS CO., LTD., Suwon-si (KR)

(72) Inventors: Woong Sun, Suwon-si (KR); Jeonguk Koh, Suwon-si (KR); Jaechan Park, Suwon-si (KR); Kwangnam Shin, Suwon-si (KR); Seungjin Yun, Suwon-si (KR); Jaewook Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 208 days.

(21) Appl. No.: 18/143,263

(22) Filed: May 4, 2023

(65) Prior Publication Data

US 2024/0019169 A1 Jan. 18, 2024

Related U.S. Application Data

(63) Continuation of application No. PCT/KR2023/005720, filed on Apr. 27, 2023.

(30) Foreign Application Priority Data

Jul. 15, 2022 (KR) ..... 10-2022-0087847

(51) Int. Cl.
*F24F 13/22* (2006.01)
*F24F 1/16* (2011.01)

(52) U.S. Cl.
CPC ..... *F24F 13/224* (2013.01); *F24F 1/16* (2013.01); *F24F 2013/227* (2013.01); *F24F 2221/34* (2013.01)

(58) Field of Classification Search
CPC ..... F24F 1/46; F24F 1/56; F24F 11/42; F24F 13/22; F24F 13/222; F24F 1/36;
(Continued)

(56) References Cited

U.S. PATENT DOCUMENTS 11,435,112 B2 * 9/2022 Watanabe ..... F24F 13/222
2014/0298844 A1 10/2014 Luo et al.
2019/0383501 A1 12/2019 Hasegawa et al.

FOREIGN PATENT DOCUMENTS

CN 203642380 U * 6/2014 ..... F24F 1/36
CN 208606293 U 3/2019
(Continued)

OTHER PUBLICATIONS

International Search Report, PCT/ISA/210, dated Aug. 16, 2023, in PCT Application No. PCT/KR2023/005720.
(Continued)

*Primary Examiner* — Kun Kai Ma
(74) *Attorney, Agent, or Firm* — STAAS & HALSEY LLP

(57) ABSTRACT

An outdoor unit of an air conditioner includes a housing including a base forming a bottom surface of the outdoor unit, a fan inside the housing to cause air to flow, a heat exchanger inside the housing to perform heat-exchange with the air caused to flow by the fan, a heater on the base, a drain plug mounted on, and penetrating, the base, and forming a drain hole through which water inside the housing is dischargeable to outside the housing, and a heat conduction plate in contact with the heater and accommodated inside the drain plug to transfer heat generated by the heater to the inside of the drain plug.

14 Claims, 13 Drawing Sheets

(58) Field of Classification Search
CPC ..... F24F 13/224; F24F 1/16; F24F 2013/227; F24F 2221/34
See application file for complete search history.

(56) References Cited

FOREIGN PATENT DOCUMENTS

| | | |
|---|---|---|
| JP | 6-18823 | 3/1994 |
| JP | 11-14097 | 1/1999 |
| JP | 2004-69220 | 3/2004 |
| JP | 2007-10269 | 1/2007 |
| JP | 3882910 | 2/2007 |
| JP | 2010-71514 | 4/2010 |
| JP | 2012-42209 | 3/2012 |
| JP | 4920650 | 4/2012 |
| JP | 5351667 | 11/2013 |
| JP | 5811982 | 11/2015 |
| JP | 6223269 | 11/2017 |
| JP | 6494786 | 4/2019 |
| JP | 6526218 | 6/2019 |
| JP | 6880215 | 6/2021 |
| KR | 20-1999-0005907 | 2/1999 |
| KR | 20-1999-0038940 | 11/1999 |
| KR | 10-2004-0098275 | 11/2004 |
| KR | 10-0565215 | 3/2006 |
| KR | 10-1428444 | 8/2014 |
| WO | WO 2017/081734 A1 | 5/2017 |

OTHER PUBLICATIONS

Written Opinion, PCT/ISA/237, dated Aug. 16, 2023, in PCT Application No. PCT/KR2023/005720.
English translation of Japanese Patent Document 2010-71514, publication date of Apr. 2, 2010.
European Search Report dated May 12, 2025, in European Application No. EP 23 83 9765.

* cited by examiner

OUTDOOR UNIT OF AIRCONDITIONER

CROSS-REFERENCE TO RELATED APPLICATIONS

This application is a continuation application of International Application No. PCT/KR2023/005720, filed on Apr. 27, 2023, and is based on and claims priority under 35 U.S.C. § 119 to Korean Patent Application No. 10-2022-0087847, filed on Jul. 15, 2022, in the Korean Intellectual Property Office, the disclosures of which are incorporated by reference herein in their entireties.

BACKGROUND

1. Field

The disclosure relates to an outdoor unit of an air conditioner having an improved structure to prevent freezing of a drain hole.

2. Discussion of Related Art

In general, an air conditioner is an apparatus including a cooling cycle, and there is a split type air conditioner including an indoor unit that is placed in an indoor space and an outdoor unit that is placed in an outdoor space.

An outdoor unit of an air conditioner includes an outdoor heat exchanger for performing heat exchange with outside air, a compressor for compressing a refrigerant, an expansion valve unit for decompressing the refrigerant, and a blower fan for forming a flow of air. Also, the outdoor unit of the air conditioner includes a housing for accommodating the outdoor heat exchanger, the expansion valve unit, the compressor, and the blower fan.

The housing of the outdoor unit of the air conditioner may include a base on which various devices are placed. The base includes a drain hole through which defrost water generated inside the outdoor unit of the air conditioner or moisture introduced from the outside is discharged to the outside.

However, when the outdoor unit of the air conditioner is installed in a cold area or in winter, ice may be formed in the drain hole, making it difficult to discharge moisture from the inside.

SUMMARY

One aspect of the disclosure provides an outdoor unit of an air conditioner having an improved drainage structure.

An outdoor unit of an air conditioner, according to an embodiment of the disclosure, includes a housing including a base forming a bottom surface of the outdoor unit, a fan inside the housing to cause air to flow, a heat exchanger inside the housing to perform heat-exchange with the air caused to flow by the fan, a heater mounted on the base, a drain plug mounted on, and penetrating, the base, and forming a drain hole through which water inside the housing is dischargeable to outside the housing, and a heat conduction plate in contact with the heater and accommodated inside the drain plug to transfer heat generated by the heater to the inside of the drain plug.

The heat conduction plate may include a support flange supported by being in contact with the heater and the drain plug, and a heating body extending from the support flange and inserted into the drain plug.

The support flange may include a heat transfer portion in contact with the heater to receive heat generated by the heater, and a bent portion bent toward the drain plug from the heat transfer portion and connected to the heating body.

The heating body may include an insertion portion extending downward from the bent portion and disposed inside of the drain plug, a heating portion connected to the insertion portion, and an auxiliary drain portion extending downward from the heating portion and accommodated inside of the drain hole of the drain plug.

The heating portion may be inclined downward toward the auxiliary drain portion.

The auxiliary drain portion may be smaller than the drain hole, and the auxiliary drain portion may have a diameter less than 12 mm.

The drain plug may include a drain body outside the base and including the drain hole, and an extension rib extending upward from the drain body, and penetrating the base.

The extension rib may include a seating groove on an upper surface of the extension rib so that a portion of the heat conduction plate is seated in the seating groove.

The drain plug may include a fixing rib extending from the drain body to form a base accommodating groove into which the base is accommodated, and a fixing hook extending from the drain body on an opposite side of the fixing rib and supported on an inner surface of the base.

The drain body may include a base connecting portion forming an upper surface of the drain body in contact with the base, and a drain guide portion inclined downward from the base connecting portion toward the drain hole.

The drain guide portion may be disposed to be spaced apart from the heat conduction plate to form a drainage space.

The drain body may include a sealing member accommodating groove on an upper surface of the drain body, and a sealing member accommodated in the sealing member accommodating groove, and sealing between the base and the drain plug.

The heater may be provided as a pair of heaters, and the drain hole may be formed in a region between the heaters of the pair of heaters.

The heat conduction plate may be disposed inside of the drain plug and spaced apart from the drain plug.

The heat conduction plate and the drain plug may be formed of different materials.

An outdoor unit of an air conditioner, according to an embodiment of the disclosure, includes a housing including a base forming a bottom surface, a blower fan disposed inside the housing to flow air, a heat exchanger disposed inside the housing to heat-exchange the air flowing from the blower fan, a heater mounted on the base, a drain plug penetrating the bottom surface of the base to be mounted on the base and forming a drain hole, and including a drain guide portion connected to the drain hole to guide water inside the housing toward the drain hole, and a heat conduction plate including a support flange supported by the heater and a heating body extending downward from the support flange and accommodated in the drain plug to be spaced apart from the drain guide portion.

The support flange may include a heat transfer portion connected to the heater and a bent portion bent downward from the heat transfer portion to connect the heat transfer portion and the heating body.

The drain plug may include a seating groove formed on an upper surface to seat the bent portion of the heat conduction plate.

An outdoor unit of an air conditioner, according to an embodiment of the disclosure, includes a housing including a base forming a bottom surface, a blower fan disposed inside the housing to flow air, a heat exchanger disposed inside the housing to exchange heat with the air flowing from the blower fan, a heater mounted on the base, an opening portion formed in the base, a drain plug supported on an inner surface of the base, and including a drain body formed with a drain hole and protruding outward of the base through the opening portion, and a heat conduction plate having both ends supported by the heater and a portion accommodated inside the drain body, and including an auxiliary drain portion having a diameter smaller than a diameter of the drain hole The auxiliary drain portion may have the diameter of 12 mm or less.

DETAILED DESCRIPTION OF EXEMPLARY EMBODIMENTS

Figure 1:
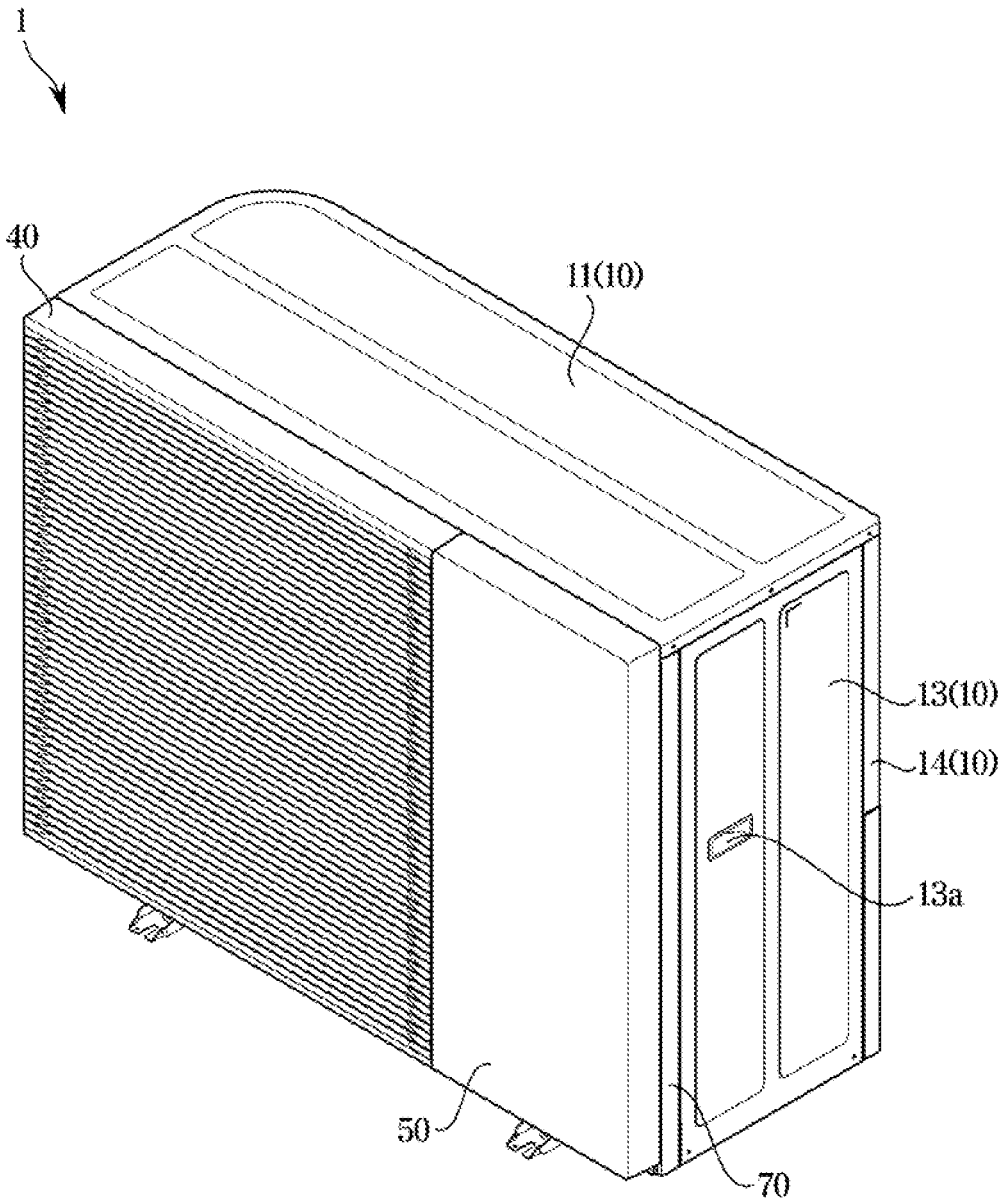
FIG. 1 is a perspective view of an outdoor unit of an air conditioner according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, embodiments of the disclosure will be described in detail with reference to the accompanying drawings.

Figure 2:
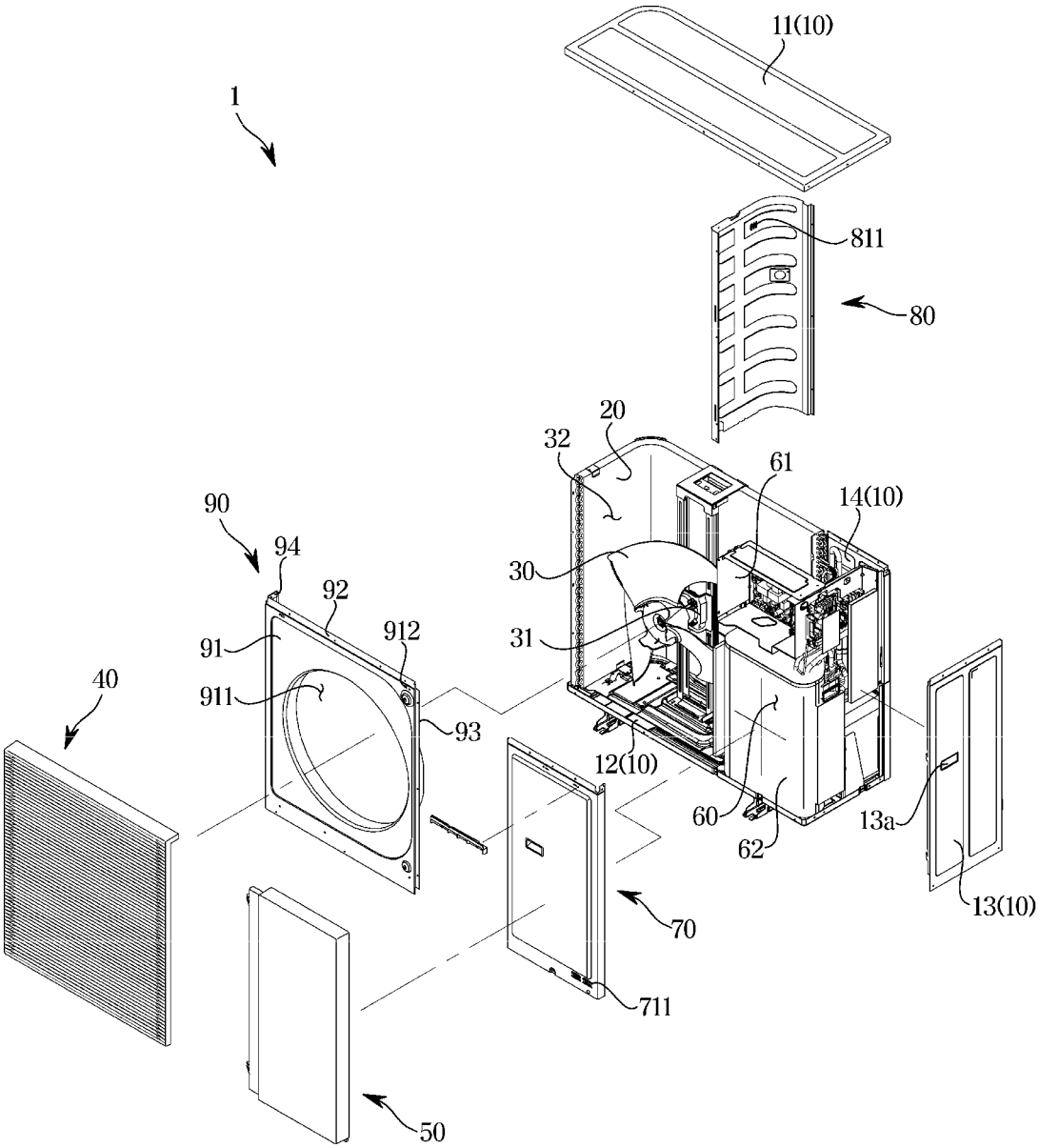
FIG. 2 is an exploded view of the outdoor unit of the air conditioner shown in FIG. 1.

FIG. 1 is a perspective view of an outdoor unit of an air conditioner according to an embodiment of the disclosure. FIG. 2 is an exploded view of the outdoor unit of the air conditioner shown in FIG. 1.

An air conditioner according to an embodiment of the present disclosure may include an indoor unit that is placed in an indoor space and an outdoor unit 1 that is placed in an outdoor space.

The indoor unit and the outdoor unit 1 may be connected to each other through a refrigerant pipe for transferring a refrigerant. In addition, although not shown in the drawing, the indoor unit and the outdoor unit 1 may be connected to each other through a wire for transferring power and electric signals.

Also, a single outdoor unit 1 may be connected with a plurality of indoor unit through refrigerant pipes.

The indoor unit (not shown) may include an indoor heat exchanger for performing heat exchange with room air, an indoor blower fan for suctioning room air and blowing the room air to cause the room air to pass through the indoor heat exchanger, and an expansion valve unit for decompressing a refrigerant to expand the refrigerant The outdoor unit 1 may include, as shown in FIGS. 1 and 2, an outdoor heat exchanger 20 for performing heat exchange with outside air, a blower fan 30 for suctioning outside air and blowing the outside air to cause the outside air to pass through the outdoor heat exchanger 20, a compressor for compressing a refrigerant, and a housing 10 forming an outer appearance of the outdoor unit 1 and accommodating the outdoor heat exchanger 20, the blower fan 30, and the compressor.

Hereinafter, the outdoor unit 1 of the air conditioner according to an embodiment of the disclosure will be described. The outdoor heat exchanger 20 is also referred to as a heat exchanger 20.

Referring to FIGS. 1 and 2, the housing 10 may include a top housing 11, a base 12, a side housing 13, and a rear housing 14.

The top housing 11 may form a top surface of the outdoor unit 1. The base 12 may form a bottom surface of the outdoor unit 1. The heat exchanger 20 and the compressor may be mounted on the base 12.

The side housing 13 may be positioned between the top housing 11 and the base 12. The side housing 13 may form a side surface of the outdoor unit 1. The side housing 13 may be coupled with the top housing 11 and the base 12.

The side housing 13 may be provided to divide a machine room 60, which will be described below, from outside. The side housing 13 may cover a side of the machine room 60 to prevent outside air from entering the machine room 60.

The side housing 13 may include a side handle 13*a*. The side handle 13*a* may be coupled with an outer surface of the side housing. However, a shape of the side handle 13*a* is not limited thereto. The side handle 13*a* may be formed by depressing one surface of the side housing 13.

An operator or a user may access the machine room 60 by gripping the side handle 13*a* and separating the side housing 13 from the outdoor unit 1.

The rear housing 14 may be positioned between the top housing 11 and the base 12. The rear housing 14 may form a portion of a rear surface of the outdoor unit 1.

The rear housing 14 may be coupled to the top housing 11 and the base 12.

The rear housing 14 may be provided to divide the machine room 60 from the outside. The rear housing 14 may cover a rear side of the machine room 60 to prevent outside air from entering the machine room 60.

The rear housing 14 may be connected to the side housing 13. The rear housing 14 and the side housing 13 may be integrally formed with each other.

The outdoor unit 1 may include the heat exchanger 20 and the blower fan 30.

The heat exchanger 20 may be mounted on the base housing 12. The heat exchanger 20 may perform heat exchange with outside air. A refrigerant may flow inside the heat exchanger 20.

The heat exchanger 20 may be accommodated in a fan accommodating room 32 to be influenced by an air current generated by the blower fan 30.

The heat exchanger 20 may be disposed inside the housing 10 to heat-exchange the air flowing from the blower fan 30.

The blower fan 30 may be positioned in front of the heat exchanger 20. The blower fan 30 may be positioned inside the housing 10 to cause air to move. More specifically, the blower fan 30 may be mounted on the base 12.

The blower fan 30 may generate a flow of air. The blower fan 30 may form an air current to cause air behind the heat exchanger 20 to move toward the heat exchanger 20. The blower fan 30 may discharge air heat-exchanged by passing through the heat exchanger 20 to the outside of the outdoor unit 1. The heat-exchanged air may be cooled or heated air.

The outdoor unit 1 may include a fan driver 31. The fan driver 31 may be coupled to the blower fan 30 to drive the blower fan 30. The fan driver 31 may include a motor for generating power.

Also, the blower fan 30 may form a circulation flow path for cooling the machine room 60.

The outdoor unit 1 may include the machine room 60. The machine room 60 may be positioned at one side of the blower fan 30. The machine room 60 may be formed to be divided from the inside of the outdoor unit 1.

The compressor for compressing a refrigerant may be positioned inside the machine room 60. A control box may be positioned inside the machine room 60. An accommodating frame 62 accommodating the compressor and a control frame 61 accommodating the control box may be positioned inside the machine room 60.

The outdoor unit 1 may include a first partition 70.

The first partition 70 may be installed inside the housing 10 so that the machine room 60 is partitioned inside the housing 10. The first partition 70 may be coupled to the base 12.

The first partition 70 may include a first flow hole 711 through which air discharged from the blower fan 30 enters the machine room 60.

The outdoor unit 1 may include a second partition 80.

The second partition 80 may be installed inside the housing 10 so that the machine room 60 is partitioned inside the housing 10. The second partition 80 may include a second flow hole 811 through which air cooled the machine room 60 is suctioned into the blower fan 30.

The second partition 80 may partition an inside space of the housing 10 into a space where the heat exchanger 20 and the blower fan 30 are installed and a space where the compressor is installed. For example, the machine room 60 may be formed on one side of the second partition 80, and the fan accommodating room 32 may be formed on the other side of the second partition 80. The machine room 60 and the fan accommodation room 32 may be divided from each other based on the second partition 80.

The second partition 80 may be provided such that a first end corresponding to a front side of the second partition 80 is connected to the first partition 70 and a second end corresponding to a rear side of the second partition 80 is connected to the heat exchanger 20. Accordingly, the second partition 80 may divide the machine room 60 from the fan accommodating room 32.

The second partition 80 may be in a shape of a curved plate having a substantially curved section. However, the shape of the second partition 80 is not limited thereto. The second partition 80 may be in a shape of a rectangle.

The outdoor unit 1 may include a support frame 90.

The support frame 90 may be positioned behind a fan guard 40 to be laterally aligned with the first partition 70, and fix a position of the fan guard 40.

The support frame 90 may include a frame body 91. The frame body 91 may be substantially in a shape of a quadrangular plate. An opening 911 may be formed in the frame body 91.

Air discharged from the blower fan 30 through the opening 911 of the frame body 91 may pass through the support frame 90 and the fan guard 40 and be discharged to the front of the outdoor unit 1 or introduced into the machine room 60.

The frame body 91 may include a guard fixing portion 912 into which a portion of the fan guard 40 is inserted.

The guide fixing portion 912 may temporarily fix the fan guard 40 in position in a state in which the fan guard 40 is spaced a preset distance from the frame body 91 in a front direction.

For example, the guard fixing portion 912 may temporarily fix the fan guard 40 in position before the fan guard 40 is screw-coupled with the frame body 91. The guard fixing portion 912 may be formed by cutting a portion of the fan guard 40 out.

The support frame 90 may include a housing coupling portion 92 and a partition coupling portion 93.

The support frame 90 may be coupled to the first partition 70 so as to be laterally aligned with the first partition 70.

The support frame 90 may be coupled to the first partition 70 through the partition coupling portion 93 extending laterally from the frame body 91. The partition coupling portion 93 may extend from the support frame 90 toward the first partition 70.

The housing coupling portion 92 may extend upward from the frame body 91 of the support frame 90. The support frame 90 may be coupled to the top housing 11 through the housing coupling portion 92.

Also, a lower portion of the frame body 91 of the support frame 90 may be coupled to the base 12. However, the disclosure is not limited thereto, and the housing coupling portion 92 may extend downward from the frame body 91 to couple the support frame 90 with the base 12.

The support frame 90 may include a heat exchanger coupling portion 94.

The support frame 90 may be coupled to one end of the heat exchanger 20 through the heat exchanger coupling portion 94. The other end of the heat exchanger 20, which is opposite to the one end of the heat exchanger 20, may be coupled to the second partition 80.

Accordingly, the fan accommodating room 32 may be defined by the heat exchanger 20, the support frame 90, and the second partition 80.

The outdoor unit 1 may include the fan guard 40.

The fan guard 40 may be positioned in front of the blower fan 30. The fan guard 40 may cover a front side of the blower fan 30 to prevent an external foreign material from entering the inside of the outdoor unit 1. For example, the fan guard 40 may cover a front side of the opening 911 of the support frame 90.

The fan guard 40 may discharge air discharged from the blower fan 30 in the front direction of the outdoor unit 1. More specifically, the fan guard 40 may include a plurality of ribs that are spaced apart from each other, in which air is discharged between the plurality of ribs.

The fan guard 40 may include a flow portion at one side toward the first partition 70 such that air discharged from the blower fan 30 moves toward the machine room 60. Air discharged from the blower fan 30 may move toward the first partition 70 through the flow portion.

More specifically, air passed through the flow portion of the fan guard 40 may move between the front cover 50 and the first partition 70 and enter the machine room 60 through the first flow hole 711 of the first partition 70.

The outdoor unit 1 may include the front cover 50.

The front cover 50 may be laterally aligned with the fan guard 40, in front of the machine room 60.

The front cover 50 may be positioned in front of the first partition 70 to be laterally aligned with the fan guard 40. For example, the front cover 50 may be positioned in front of the first partition 70 to guide air passed through the flow portion of the fan guard 40 to the first flow hole 711 of the first partition 70.

For example, the front cover 50 may function as a duct forming a flow path through which air discharged from the side of the fan guard 40 enters the machine room 60.

The front cover 50 may form a front outer appearance of the outdoor unit 1 together with the fan guard 40.

Figure 3:
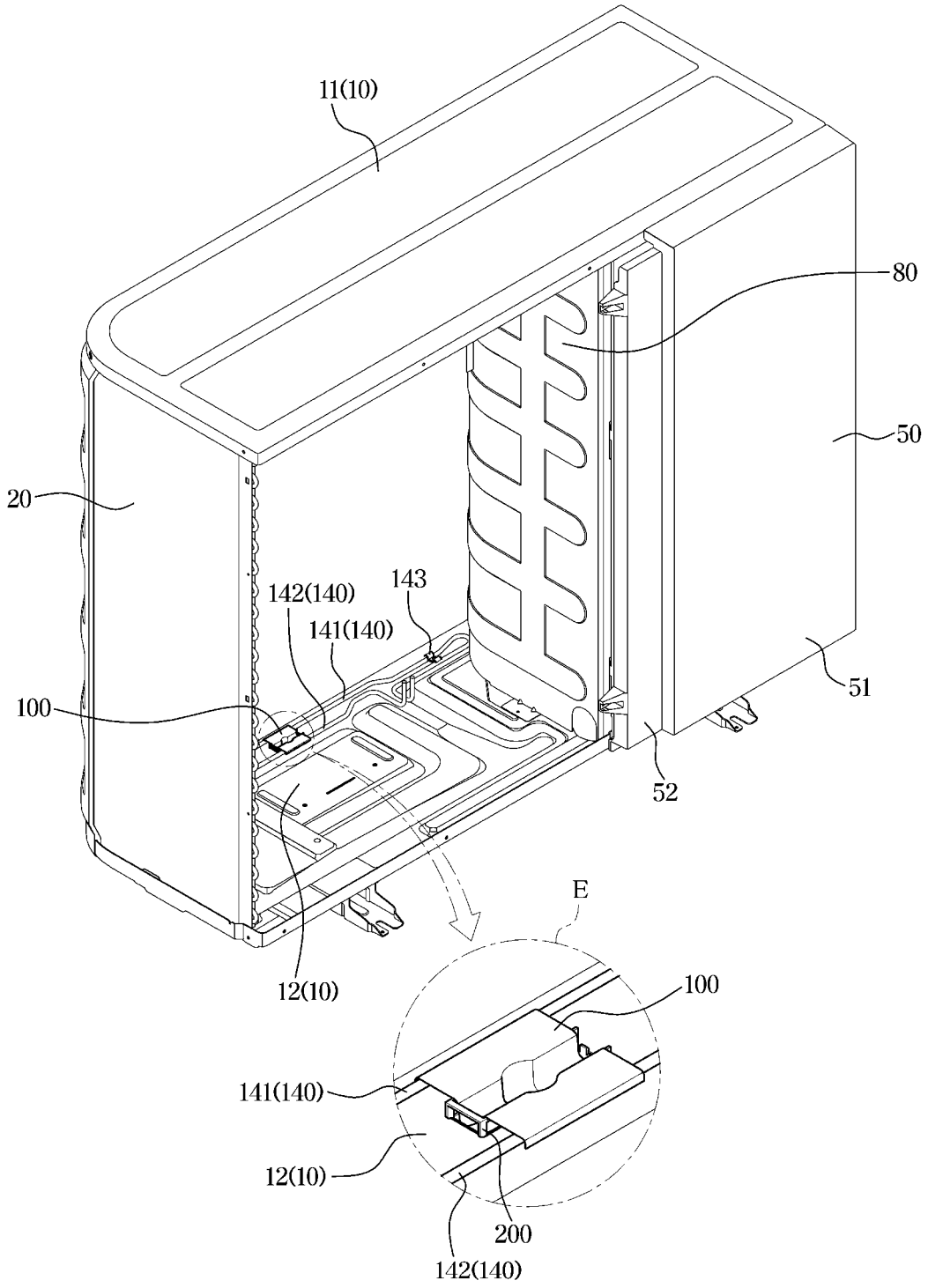
FIG. 3 is a view illustrating a base by removing some parts of the outdoor unit of the air conditioner shown in FIG. 1.

FIG. 3 is a view showing a base by removing some parts of the outdoor unit of the air conditioner shown in FIG. 1.

FIG. 3 is a view omitting the fan guard 40, the support frame 90, the blower fan 30, and the fan driving unit 31 from the outdoor unit 1 of the air conditioner shown in FIG. 1.

Referring to FIG. 3, a heater 140 may be mounted on the base 12 of the outdoor unit 1. The heater 140 may be disposed on the inner surface of the base 12 along the left and right directions of the base 12. The heater 140 may be provided to prevent freezing of defrosting water generated in the outdoor unit 1 or water from an external environment such as snow and rain from freezing on the base 12.

The heater 140 may include a first heater 141 and a second heater 142. The first heater 141 and the second heater 142 may be symmetrically disposed around a heat conduction plate 100 described below. For example, the heater 140 may be provided as a pair including the first heater 141 and the second heater 142 around the heat conduction plate 100. A discharge hole may be formed in a region between the pair of heaters 140 (see FIG. 11).

Here, the fact that the heater 140 is provided as a pair including the first heater 141 and the second heater 142 is taken to mean that the pair of heaters 141 and 142 are arranged on both sides of the heat conduction plate 100 based on the heat conduction plate 100. Accordingly, the first heater 141 and the second heater 142 may be substantially the same heater 140. However, it is not limited thereto, and the first heater 141 and the second heater 142 may be provided as separate heat sources.

The heater 140 may be fixed to the base 12 by a mounting bracket 143. The mounting bracket 143 may be mounted on the base 12 while covering the top of the heater 140. The mounting bracket 143 may be screwed to the base 12. By this configuration, the position of the heater 140 relative to the base 12 may be fixed.

As shown in FIG. 3, the heater 140 may be disposed on the rear inner surface of the base 12. However, the location of the heater 140 is not limited thereto. For example, the heater 140 may be disposed on a lateral inner surface of the base 12.

The heater 140 may be spaced apart from the inner surface of the base 12 by a predetermined distance by the mounting bracket 143. For example, the heater 140 may be fixed on the base 12 to be spaced upward from the inner surface of the base 12.

Both ends of the heat conduction plate 100 may be supported by the heater 140. For example, one end of the heat conduction plate 100 may be supported by the first heater 141 by being in contact with the first heater 141. The other end opposite to the one end of the heat conduction plate 100 may be supported by the second heater 142 by being in contact with the second heater 142.

The heat conduction plate 100 may be seated on a drain plug 200 that is mounted on the base 12 by penetrating the base 12. The heat conduction plate 100 may be accommodated inside the drain plug 200 to transfer heat generated from the heater 140 to the inside of the drain plug 200.

For example, a portion of the heat conduction plate 100 may be connected to the heater 140 and disposed above the drain plug 200, while the remaining portion of the heat conduction plate 100 may be inserted into the drain plug 200. Details thereof will be described below.

Figure 4:
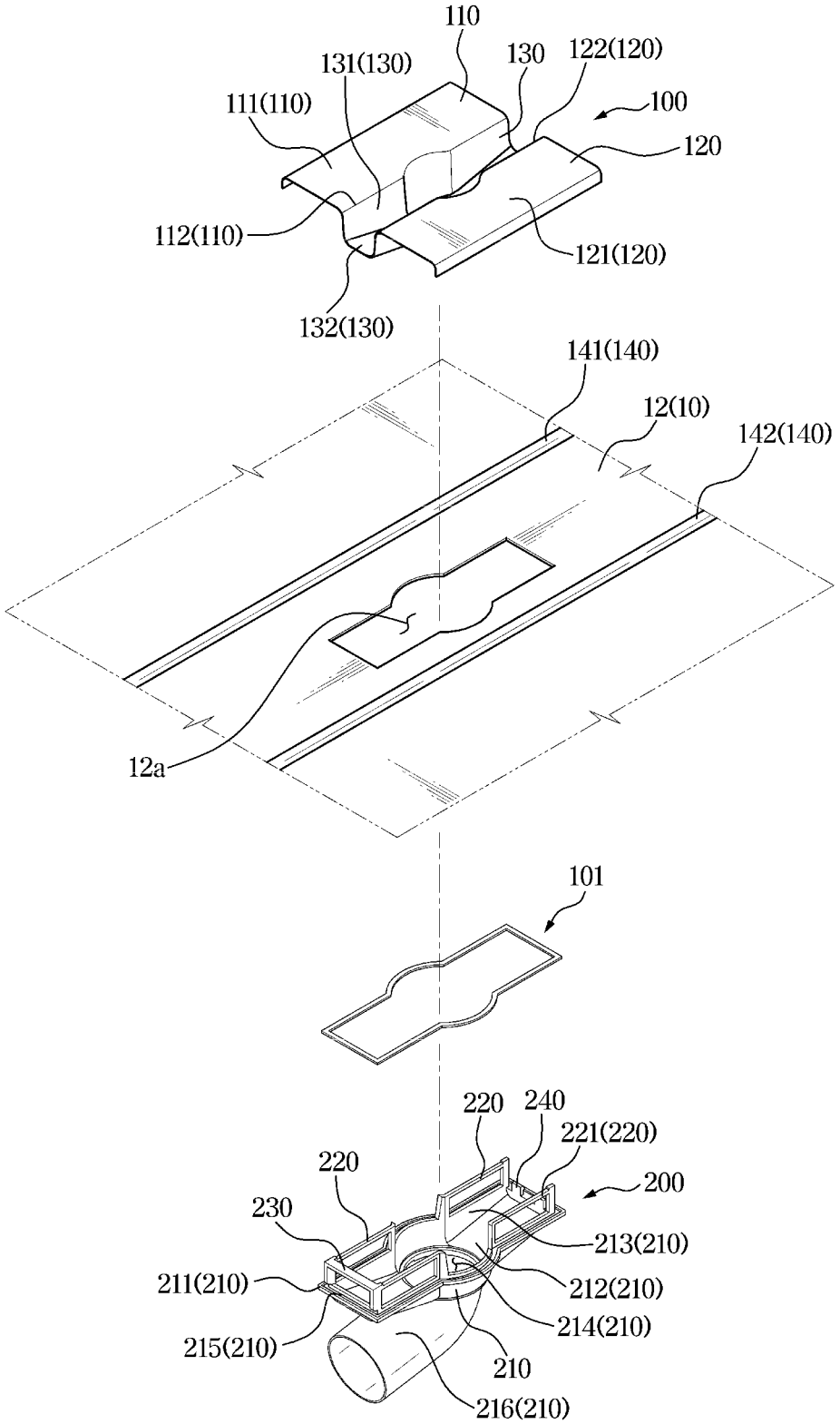
FIG. 4 is an exploded view illustrating part E of FIG. 3.

FIG. 4 is an exploded view illustrating part E of FIG. 3.

Hereinafter, the drainage structure of the disclosure will be described.

As shown in FIG. 4, the first heater 141 and the second heater 142 may be installed on the base 12 of the outdoor unit 1. An opening portion 12*a* may be formed in a region between the first heater 141 and the second heater 142. The opening portion 12*a* may be formed by cutting a portion of the base 12.

The outdoor unit 1 may include the heat conduction plate 100 supported by the first heater 141 and the second heater 142. With both ends of the heat conduction plate 100 in contact with the first heater 141 and the second heater 142, the heat conduction plate 100 may penetrate the opening portion 12*a* of the base 12.

The outdoor unit 1 may include a drain plug 200.

The drain plug 200 may be supported on the inner surface of the base 12. A portion of the drain plug 200 may be accommodated inside of the base 12. The remaining portion of the drain plug 200 may protrude to the outside of the base 12 through the opening portion 12*a* of the base 12.

The drain plug 200 may be mounted on the base 12 and penetrate the bottom surface of the outdoor unit 1.

The heat conduction plate 100 may include a support flange. The support flange may include a first support flange 110 and a second support flange 120.

The support flange may include a heating body 130 connected to the first support flange 110 and the second support flange 120. The heating body 130 may extend from the support flanges 110 and 120 to be inserted into the drain plug 200.

For example, the first support flange 110 and the second support flange 120 may be provided in symmetrical shapes at both ends of the heating body 130 and connected to the heating body 130.

The first support flange 110 may be supported by being in contact with the first heater 141 and the drain plug 200. An end portion of the first support flange 110 may be connected to the first heater 141 so as to cover a portion of the first heater 141.

The first support flange 110 may include a first heat transfer portion 111 and a first bent portion 112.

The first heat transfer portion 111 may be in contact with the first heater 141 and receive heat generated from the first heater 141. For example, an end portion of the first heat transfer portion 111 may be in contact with the first heater 141.

The first heat transfer portion 111 may be provided in a plate shape covering a region between the drain plug 200 and the first heater 141. As shown in FIG. 4, the first heat transfer portion 111 may have a substantially rectangular shape, but the shape of the first heat transfer portion 111 is not limited thereto.

For example, the first heat transfer portion 111 may have a cross section gradually narrowing from the first heater 141 toward the first bent portion 112. Alternatively, the first heat transfer portion 111 may extend in a linear shape instead of the plate shape, and provided in plurality. That is, the first heat transfer portion 111 may be provided in various shapes as long as it can transfer heat to the heating body 130.

The first bent portion 112 may be bent toward the drain plug 200 from the first heat transfer portion 111. The first bent portion 112 may be connected to the heating body 130. As described below, the first bent portion 112 may be supported by a seating groove 221 of the drain plug 200.

The first support flange 110 may be supported by being in contact with the first heater 141 and the drain plug 200. The end portion of the first support flange 110 may be connected to the first heater 141 so as to cover a portion of the first heater 141.

The second support flange 120 may include a second heat transfer portion 121 and a second bent portion 122.

The second heat transfer portion 121 may be in contact with the second heater 142 to receive heat generated from the second heater 142. For example, an end portion of the second heat transfer portion 121 may be contact with the second heater 142.

The second heat transfer portion 121 may be provided in a plate shape covering a region between the drain plug 200 and the second heater 142. As shown in FIG. 4, the second heat transfer portion 121 may have a substantially rectangular shape, but the shape of the second heat transfer portion 121 is not limited thereto.

For example, the second heat transfer portion 121 may have a cross section gradually narrowing from the second heater 142 toward the second bent portion 122. Alternatively, the second heat transfer portion 121 may extend in a linear shape instead of the plate shape, and provided in plurality. That is, the second heat transfer portion 121 may be provided in various shapes as long as it can transfer heat to the heating body 130.

The second bent portion 122 may be bent toward the drain plug 200 from the second heat transfer portion 121. The second bent portion 122 may be connected to the heating body 130. As described below, the second bent portion 122 may be supported by the seating groove 221 of the drain plug 200.

A detailed description of the heating body 130 of the heat conduction plate 100 will be described below.

The heat conduction plate 100 may be formed of a material having high thermal conductivity. For example, the heat conduction plate 100 may include a material such as copper Cu, aluminum Al, or stainless steel SUS. However, the material of the heat conduction plate 100 is not limited thereto, and any material having heat resistance and corrosion resistance is sufficient.

The drain plug 200 may penetrate the base 12 to be mounted on the base 12. The drain plug 200 may include a drain body 210.

The drain body 210 may be disposed outside of the base 12. For example, the drain body 210 of the drain plug 200 may protrude outward from the base 12 through the opening portion 12*a* of the base 12.

The drain body 210 may include a base connecting portion 211, a drain guide portion 212, a side wall portion 213, and a drain hole 214.

The base connecting portion 211 may form an upper surface of the drain body 210 in contact with the base 12. An upper surface of the base connecting portion 211 may be in contact with an outer surface of the base 12. For example, the base connecting portion 211 may be disposed to be in contact with an outer lower surface of the base 12.

A sealing member accommodating groove 215 may be formed on the upper surface of the drain body 210. More specifically, the sealing member accommodating groove 215 may be formed on the upper surface of the base connecting portion 211 of the drain body 210. A sealing member 101 including a rubber material may be accommodated in the sealing member accommodating groove 215.

The sealing member 101 may be provided to seal a gap between the base 12 and the drain plug 200. The sealing member 101 may be provided in a shape corresponding to the opening portion 12*a* of the base 12. The sealing member 101 may be provided in a shape having the same ratio as that of the opening portion 12*a* of the base 12 and may be provided slightly larger than the opening portion 12*a* of the base 12 to secure airtightness.

However, the material of the sealing member 101 is not limited thereto, and any material capable of shape deformation is sufficient.

Therefore, by disposing the sealing member 101 on the drain plug 200, airtightness between the base 12 and the drain plug 200 may be secured in a state where the drain plug 200 is coupled to the base 12.

The side wall portion 213 may extend downward from the base connecting portion 211. The drain guide portion 212 may be formed to be inclined downward from the base connecting portion 211 toward the drain hole 214.

For example, the drain guide portion 212 may extend from the side wall portion 213 connected to the base connecting portion 211 to form an inner bottom surface of the drain plug 200.

Since the drain guide portion 212 is formed to be inclined downward, water collected in the base 12 may be more smoothly discharged to the drain hole 214 by gravity.

The drain plug 200 may form the drain hole 214 through which water inside the housing 10 is discharged to the outside. For example, the drain hole 214 may at the center of the drain guide portion 212 that is open.

The drain hole 214 may be open in a circular shape. However, the shape of the drain hole 214 is not limited thereto and may be formed in an elliptical shape. The side wall portion 213 of the drain plug 200 may include a curved portion corresponding to the shape of the drain hole 214.

The drain plug 200 may include a drain pipe 216 communicating with the drain hole 214. The drain pipe 216 may be formed of a pipe having a diameter corresponding to the diameter of the drain hole 214. The user of the outdoor unit 1 may discharge water inside the outdoor unit 1 to a desired location using the drain pipe 216 by connecting a separate connection pipe to the drain pipe 216 of the drain plug 200.

The drain plug 200 may include an extension rib 220 that extends upward from the drain body 210, penetrates the base 12, and is disposed inside the base 12.

The extension rib 220 may extend toward the heat conduction plate 100 so as to support the first support flange 110 and the second support flange 120 of the heat conduction plate 100 from below.

A seating groove 221 may be formed on an upper surface of the extension rib 220. A portion of the heat conduction plate 100 may be seated in the seating groove 221 of the extension rib 220. The extension ribs 220 may be formed to face each other at both sides of the drain plug 200.

As shown in FIG. 4, the number of extension ribs 220 may be formed with a total of four, but the number of extension ribs 220 is not limited thereto.

For example, a total of two extension ribs 220 may be formed, one on one side and the other on the opposite side of the drain plug 200. Alternatively, the extension rib 220 may be integrally formed along an upper edge of the drain plug 200.

The drain plug 200 may include a fixing rib 230 and a fixing hook 240.

The fixing rib 230 may extend upward from the drain body 210. The fixing rib 230 may be disposed between the extension ribs 220 facing each other. The fixing rib 230 may be connected to the extension rib 220. The base 12 may be inserted between the fixing rib 230 and the base connecting portion 211. Details thereof will be described below.

The fixing hook 240 may extend upward from the drain body 210. The fixing hook 240 may be provided to be supported on the inner surface of the base 12 by extending from the drain body 210 at the opposite side of the fixing rib 230. Details thereof will be described below.

Figure 5:
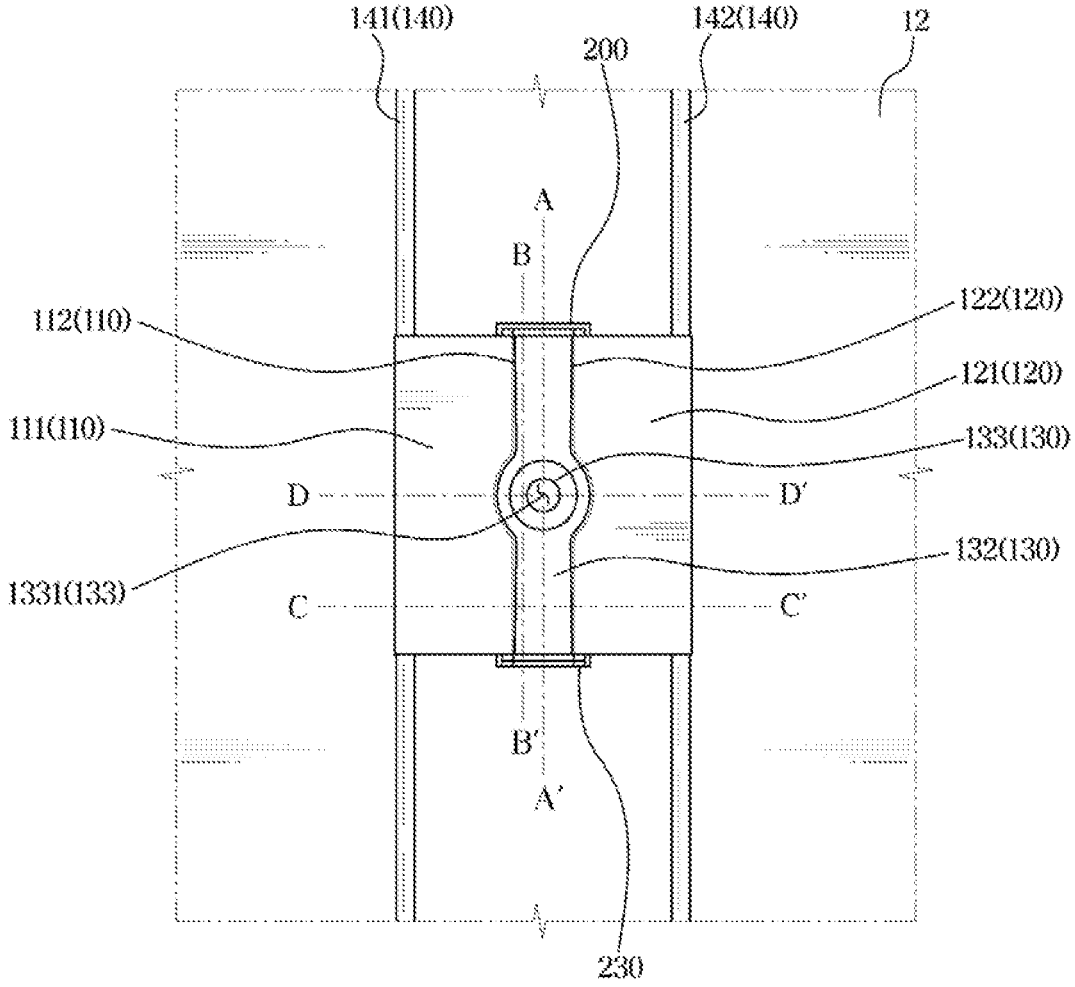
FIG. 5 is a top view illustrating part E of FIG. 3.

FIG. 5 is a top view showing part E of FIG. 3.

Referring to FIG. 5, the first support flange 110 of the heat conduction plate 100 may be supported by the first heater 141 and the second support flange 120 of the heat conduction plate 100 may be supported by the second heater 142. Therefore, both ends of the heat conduction plate 100 may be supported by the first heater 141 and the second heater 142.

The heating body 130 of the heat conduction plate 100 may be accommodated inside the drain plug 200. An auxiliary drain portion 133 may be formed at the center of the heating body 130. The auxiliary drain portion 133 may be disposed inside of the drain hole 214 of the drain plug 200. The auxiliary drain portion 133 may include a communication hole 1331 communicating with the drain hole 214. Details of the auxiliary drain portion 133 will be described below.

Figure 6:
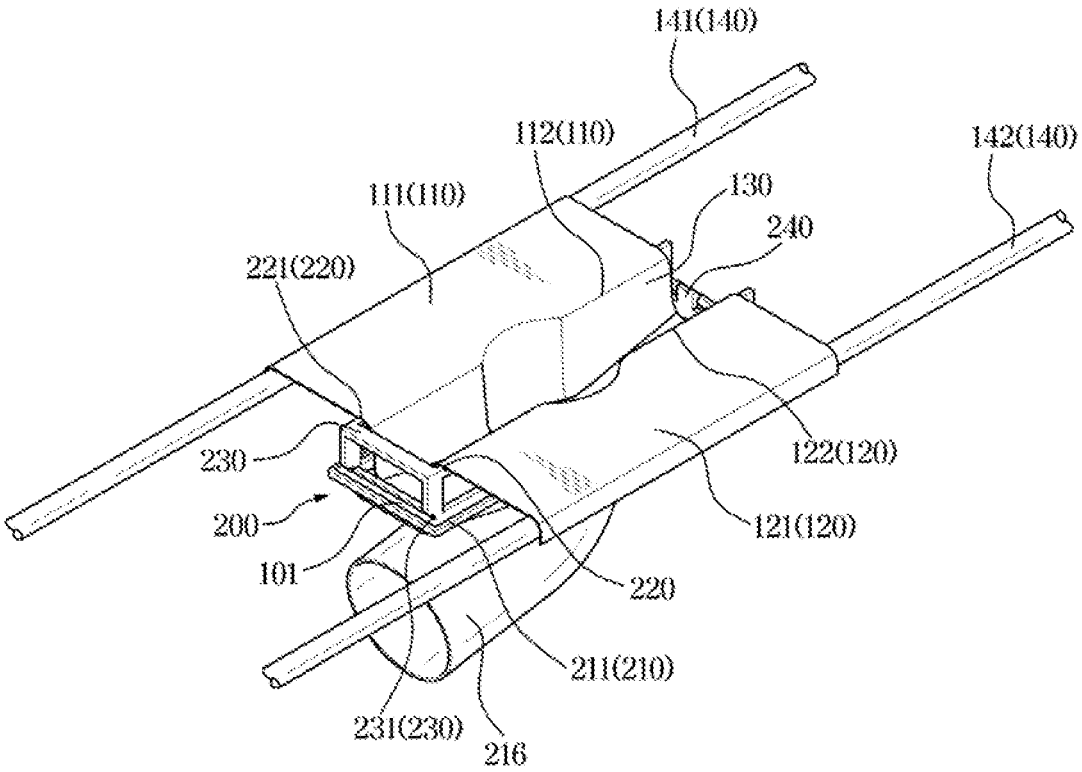
FIG. 6 is a perspective view illustrating part E of FIG. 3 obtained from one side by omitting the base.
Figure 7:
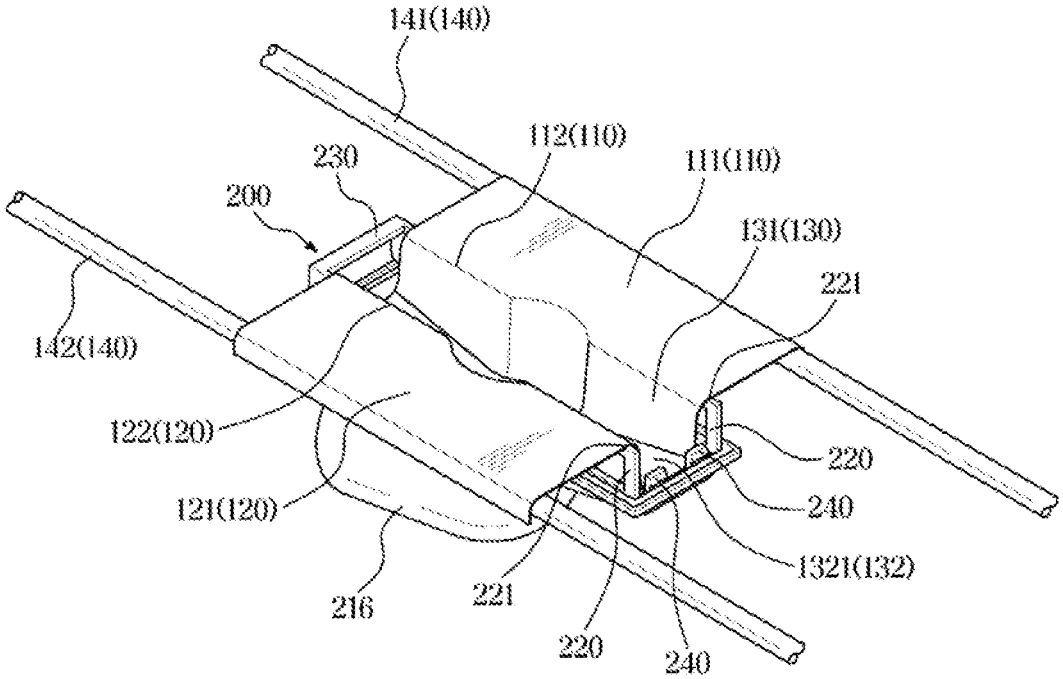
FIG. 7 is a perspective view illustrating part E of FIG. 3 obtained from another side by omitting the base.

FIG. 6 is a perspective view showing part E of FIG. 3 by omitting the base from one side. FIG. 7 is a perspective view showing part E of FIG. 3 by omitting the base from another side.

Referring to FIGS. 6 and 7, the first bent portion 112 and the second bent portion 122 of the heat conduction plate 100 may be seated in the seating groove 221 of the extension rib 220.

The heating body 130 of the heat conduction plate 100 may be connected to the first bent portion 112 and the second bent portion 122 and accommodated inside the drain plug 200. Through this, the heat conduction plate 100 may receive heat from the first heater 141 and the second heater 142 to prevent freezing in the drain plug 200.

As shown in FIG. 6, the fixing rib 230 of the drain plug 200 may include a base accommodating groove 231.

More specifically, the fixing rib 230 of the drain plug 200 may extend from the drain body 210 to form the base accommodating groove 231 into which the base 12 is inserted.

For example, the base accommodating groove 231 may be formed by recessing a portion of the fixing rib 230 inward so that the base 12 is fitted between the fixing rib 230 and the base connecting portion 211.

As shown in FIGS. 6 and 7, the fixing hook 240 of the drain plug 200 may extend upward from the base connecting portion 211.

The fixing hook 240 may be formed to have an upper thickness and a lower thickness different from each other. Through this, an upper portion of the fixing hook 240 may be supported on the inner surface of the base 12.

Figure 8:
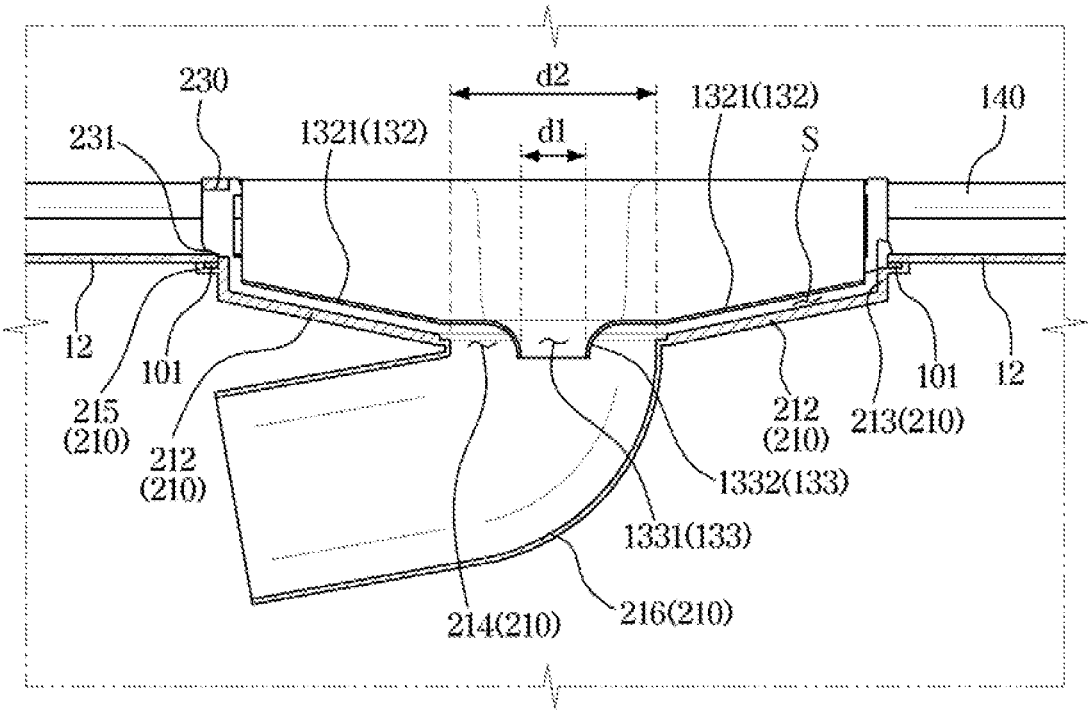
FIG. 8 is a cross-sectional view taken along the line A-A' of FIG. 5.
Figure 9:
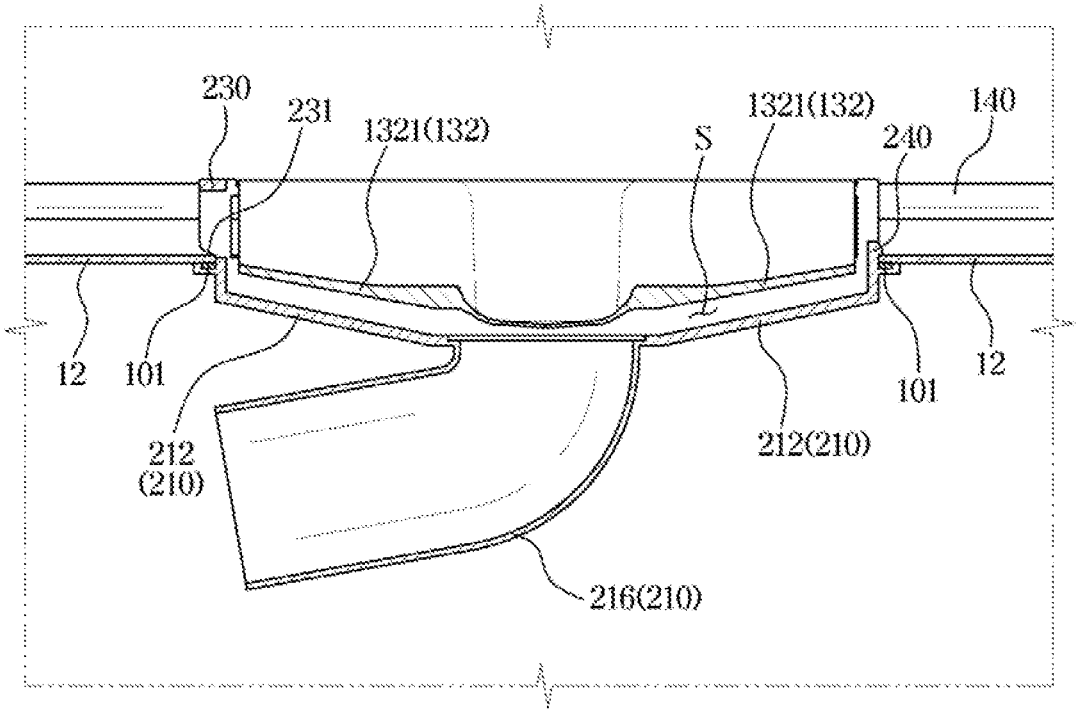
FIG. 9 is a cross-sectional view taken along the line B-B' of FIG. 5.

FIG. 8 is a cross-sectional view taken along the line A-A' of FIG. 5. FIG. 9 is a cross-sectional view taken along the line B-B' of FIG. 5.

Referring to FIGS. 6 to 9, the heating body 130 may include an insertion portion 131, a heating portion 132, and an auxiliary drain portion 133.

The insertion portion 131 of the heating body 130 may extend downward from the first bent portion 112 and the second bent portion 122 of the heat conduction plate 100 and be disposed inside the drain plug 200.

The insertion portion 131 at one side of the heating body 130 may extend downward from the first bent portion 112 and be disposed inside the drain plug 200. The insertion portion 131 on another side of the heating body 130 may extend downward from the second bent portion 122 and be disposed inside the drain plug 200.

The heating portion 132 of the heating body 130 may be provided to be connected to the insertion portion 131. The heating portion 132 of the heating body 130 may form a bottom surface of the heat conduction plate 100.

The auxiliary drain portion 133 of the heating body 130 may extend downward from the heating portion 132 and be accommodated inside the drain hole 214 of the drain plug 200.

The heating portion 132 may be inclined downward toward the auxiliary drain portion 133. For example, the heating portion 132 may include an inclined surface 1321.

The heating portion 132 may be provided in a shape corresponding to the shape of the drain guide portion 212 of the drain plug 200.

The auxiliary drain portion 133 may include an extension portion 1332 and a communication hole 1331. The extension portion 1332 of the auxiliary drain portion 133 may extend downward from the heating portion 132 and be accommodated inside the drain hole 214. A communication hole 1331 open to communicate with the drain hole 214 may be formed inside the extension portion 1332 of the auxiliary drain portion 133.

The drain plug 200 may be mounted on the base 12 to penetrate the bottom surface of the base 12 to form a drain hole 214. The drain guide portion 212 may be connected to the drain hole 214 to guide water inside the housing 10 toward the drain hole 214.

The drain guide portion 212 of the drain plug 200 may be inclined downward toward the drain hole 214.

Accordingly, the heat conduction plate 100 may be disposed inside the drain plug 200 to be spaced apart from the drain plug 200.

For example, the heating body 130 of the heat conduction plate 100 may extend downward from the support flange and be accommodated in the drain plug 200 to be spaced apart from the drain guide portion 212.

The drain guide portion 212 is disposed to be spaced apart from the heat conduction plate 100 to form a drainage space S. Accordingly, water collected inside the base 12 may flow into the drainage space S formed between the drain plug 200 and the heat conduction plate 100.

In this case, as the drain guide portion 212 is inclined downward toward the drain hole 214, water may be discharged more easily.

In addition, water collected on the heat conduction plate 100 may also be discharged to the drain hole 214 through the communication hole 1331 of the auxiliary drain portion 133.

The auxiliary drain portion 133 may be provided with a smaller size than the drain hole 214. That is, the diameter d1 of the communication hole 1331 of the auxiliary drain portion 133 may be smaller than the diameter d2 of the drain hole 214.

The diameter d1 of the auxiliary drain portion 133 and the diameter d1 of the communication hole 1331 are used as the same meaning. For example, the diameter d1 of the auxiliary drain portion 133 may be less than 12 mm.

Therefore, by forming the diameter of the auxiliary drain portion 133 to be smaller than the diameter of the drain hole 214, it is possible to prevent organisms such as rodents or insects from outside the outdoor unit 1 from entering the inside of the outdoor unit 1.

Referring to FIG. 9, one side of the drain plug 200 may be fixed to the base 12 by the base accommodating groove 231 formed on the fixing rib 230.

Another side opposite to the one side of the drain plug 200 may be fixed to the base 12 by the fixing hook 240. For example, an upper portion of the fixing hook 240 of the drain plug 200 may be supported by the base 12.

The fixing hook 240 of the drain plug 200 may be provided to be partially elastically deformable. Therefore, the drain plug 200 may be fixed to the base 12 by fitting the base accommodating groove 231 of the drain plug 200 to the base 12 and press-fitting the other side of the drain plug 200 into the base 12.

Figure 10:
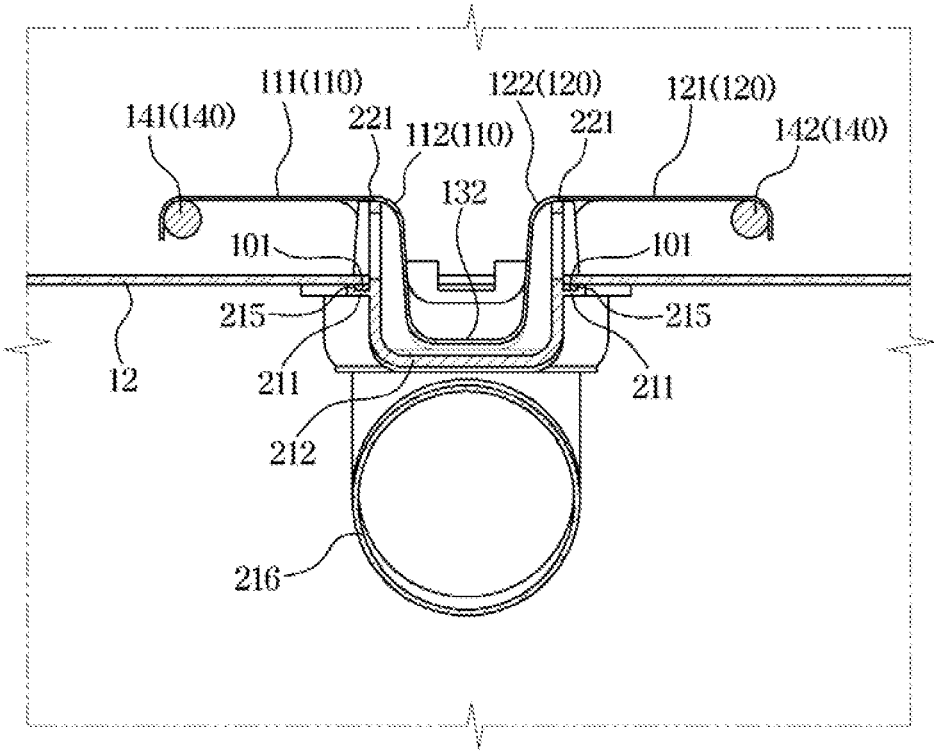
FIG. 10 is a cross-sectional view taken along the line C-C' of FIG. 5.
Figure 11:
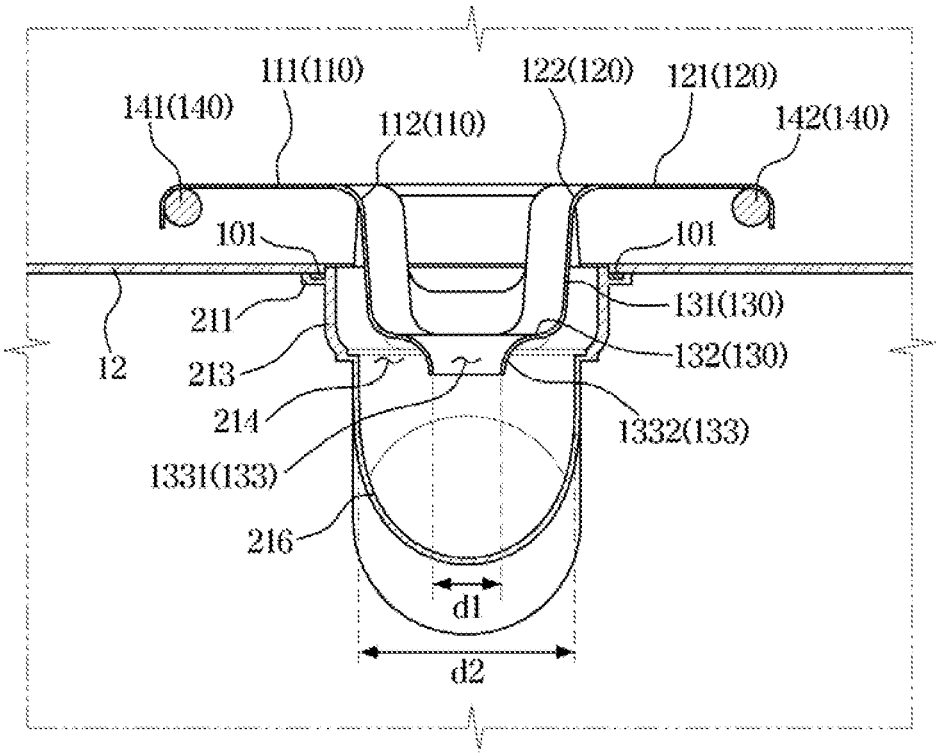
FIG. 11 is a cross-sectional view taken along the line D-D' of FIG. 5.

FIG. 10 is a cross-sectional view taken along the line C-C' of FIG. 5. FIG. 11 is a cross-sectional view taken along the line D-D' of FIG. 5.

Referring to FIGS. 10 and 11, the heat conduction plate 100 may be disposed inside the drain plug 200 to be spaced apart from the drain plug 200.

Specifically, the heating portion 132 of the heat conduction plate 100 may be spaced apart upward from the drain guide portion 212 of the drain plug 200. Since the first support flange 110 and the second support flange 120 of the heat conduction plate 100 are supported by the first heater 141 and the second heater 142, the heating body 130 of the heat conduction plate 100 may be provided with a structure to easily supply heat to the inside of the drain plug 200, while being spaced apart from the drain plug 200.

The heat conduction plate 100 and the drain plug 200 may be formed of different materials. The heat conduction plate 100 may be formed of a metal material having high thermal conductivity, and the drain plug 200 may be formed of a resin material that is easily injected.

Therefore, when the contact area between the heat conduction plate 100 and the drain plug 200 is widened, the drain plug 200 may be deformed.

Thus, the heat conduction plate 100 of the disclosure is provided to minimize the contact area with the drain plug 200, and has a technical effect of preventing deformation and performance degradation of the drain plug 200.

In the case of the disclosure, the first heat transfer portion 111 of the first support flange 110 may be supported by the first heater 141, and the first bent portion 112 of the first support flange 110 may be supported by the seating groove 221 of the drain plug 200.

In addition, the second heat transfer portion 121 of the second support flange 120 may be supported by the second heater 142, and the second bent portion 122 of the second support flange 120 may be supported by the seating groove 221 of the drain plug 200.

However, it is not limited thereto, the first bent portion 112 of the first support flange 110 and the second bent portion 122 of the second support flange 120 may be provided to be spaced apart from the seating groove 221 of the drain plug 200.

In this case, both ends of the heat conduction plate 100 may be supported only by the first heater 141 and the second heater 142, so the thermal effect of the heat conduction plate 100 on the drain plug 200 may be minimized.

In addition, both ends of the heat conduction plate 100 according to an embodiment of the disclosure may be supported by the first heater 141 and the second heater 142, as described above.

However, it is not limited thereto, the heat conduction plate 100 may be supported by one of the first heater 141 and the second heater 142.

In this case, the heat conduction plate 100 may be fixedly disposed on the base 12, in such a manner that one end of the heat conduction plate 100 is supported by the heater 140 and another end is screwed to the base 12.

In addition, the outdoor unit 1 of the disclosure may be designed as an outdoor unit 1 having a more compact structure, by disposing only the heat conduction plate 100 to penetrate the open portion 12*a* of the base 12 without the configuration of the drain plug 200.

In addition, in the outdoor unit 1 of the disclosure, the drain hole 214 may not be formed between the first heater 141 and the second heater 142 depending on the arrangement of components installed on the base 12. In this case, the drain hole 214 may be formed on the outside of the first heater 141 or the outside of the second heater 142 at a location closer to either the first heater 141 or the second heater 142.

In this case, as described above, the heat conduction plate 100 may be formed in a shape in which only one end portion is supported by the heater 140.

The shape of the outdoor unit for implementing the drainage structure of the disclosure is not limited to the outdoor unit shown in the drawings.

According to the disclosure, by disposing the heat conduction plate 100 inside the drain plug 200, it is possible to prevent freezing of the outdoor unit 1 in a cold area or in winter. Through this, a technical effect may be provided in which the water inside the outdoor unit 1 can be easily discharged regardless of the temperature outside the outdoor unit 1.

In addition, since the heat conduction plate 100 widely covers an area between the drain plug 200 and the heater 140, a technical effect of preventing freezing of the surroundings of the drain plug 200 as well as the inside of the drain plug 200 may be provided.

In particular, when snow flows into the outdoor unit 1 through the fan guard 40, it is possible to immediately melt the snow accumulated on the heat conduction plate 100 to prevent freezing.

In addition, by forming the auxiliary drain portion 133 inside the drain hole 214, a technical effect of preventing external organisms from entering the outdoor unit 1 and causing a malfunction of the outdoor unit 1 may be provided.

Figure 12:
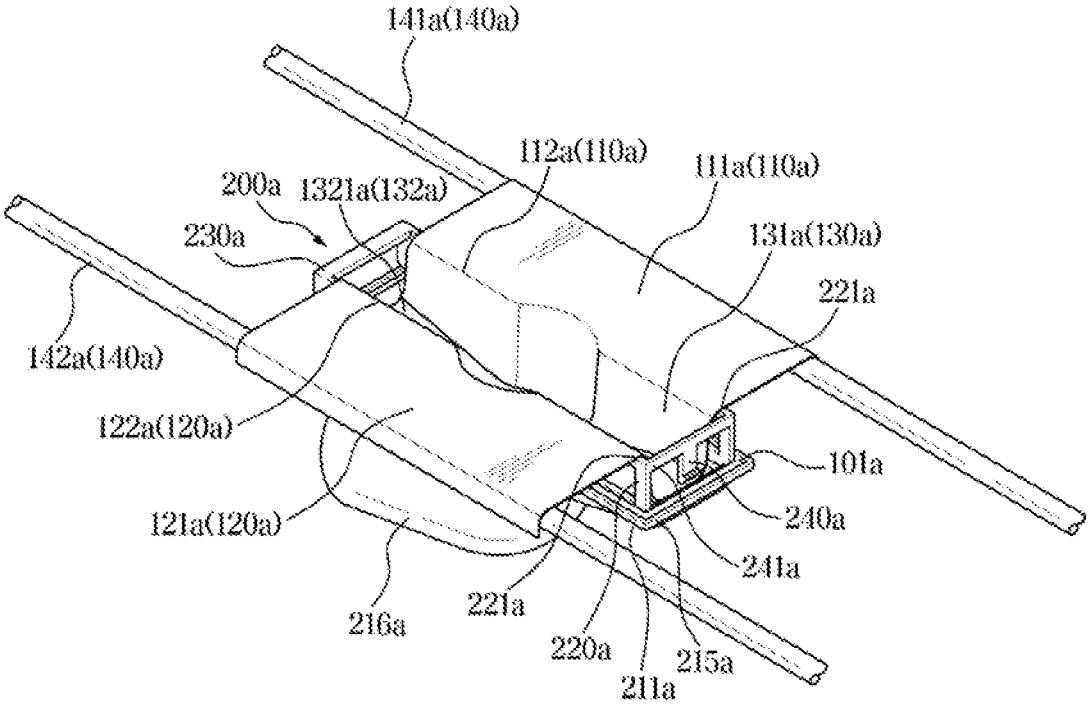
FIG. 12 shows some configurations of an outdoor unit of an air conditioner according to an embodiment of the disclosure.

FIG. 12 shows some configurations of an outdoor unit of an air conditioner according to an embodiment of the disclosure.

A partial configuration of an outdoor unit of an air conditioner according to an embodiment of the present disclosure will be described with reference to FIG. 12.

The outdoor unit of the air conditioner shown in FIG. 12 may include the same main components as the outdoor unit of the air conditioner shown in FIGS. 1 to 11. Components not described below may be provided with the same configuration as the outdoor unit of the air conditioner shown in FIGS. 1 to 11 and may include the same reference numerals.

Referring to FIG. 12, a first heater 141*a* and a second heater 142*a* may be installed at the base of the outdoor unit. The opening portion may be formed in a region between the first heater 141*a* and the second heater 142*a*. The opening portion may be formed by cutting a portion of the base.

The outdoor unit 1 may include a heat conduction plate 100*a* supported by the first heater 141*a* and the second heater 142*a*.

The heat conduction plate 100*a* may include a support flange. The support flange may include a first support flange 110*a* and a second support flange 120*a*.

The support flange may include a heating body 130*a* connected to the first support flange 110*a* and the second support flange 120*a*. The heating body 130*a* may extend from the support flange and be inserted into the drain plug 200*a*.

For example, the first support flange 110*a* and the second support flange 120*a* may be provided in symmetrical shapes at both ends of the heating body 130*a* and connected to the heating body 130*a*.

The first support flange 110*a* may be supported by being in contact with the first heater 141*a* and the drain plug 200*a*. An end portion of the first support flange 110*a* may be connected to the first heater 141*a* so as to cover a portion of the first heater 141*a*.

The first support flange 110*a* may include a first heat transfer portion 111*a* and a first bent portion 112*a*.

The first heat transfer portion 111*a* may be in contact with the first heater 141*a* to receive heat generated from the first heater 141*a*. For example, an end portion of the first heat transfer portion 111*a* may be in contact with the first heater 141*a*.

The first heat transfer portion 111*a* may be provided in a plate shape covering an area between the drain plug 200*a* and the first heater 141*a*. A shown in FIG. 12, the first heat transfer portion 111*a* may have a substantially rectangular shape, but the shape of the first heat transfer portion 111*a* is not limited thereto.

For example, the first heat transfer portion 111*a* may have a cross section gradually narrowing from the first heater 141*a* toward the first bent portion 112*a*. Or, the first heat transfer portion 111*a* may be extended in a linear shape instead of the plate shape and provided in plurality. That is, the first heat transfer portion 111*a* is sufficient to have a shape capable of transferring heat to the heating body 130*a*.

The first bent portion 112*a* may be bent toward the drain plug 200*a* from the first heat transfer portion 111*a*. The first bent portion 112*a* may be connected to the heating body 130*a*. As described below, the first bent portion 112*a* may be supported by a seating groove 221*a* of the drain plug 200*a*.

The first support flange 110*a* may be supported by being in contact with the first heater 141*a* and the drain plug 200*a*. The end portion of the first support flange 110*a* may be connected to the first heater 141*a* so as to cover a portion of the first heater 141*a*.

The second support flange 120*a* may include a second heat transfer portion 121*a* and a second bent portion 122*a*.

The second heat transfer portion 121*a* may be in contact with the second heater 142*a* to receive heat generated from the second heater 142*a*. For example, an end portion of the second heat transfer portion 121*a* may be in contact with the second heater 142*a*.

The second heat transfer portion 121*a* may be provided in a plate shape covering a region between the drain plug 200*a* and the second heater 142*a*. As shown in FIG. 12, the second heat transfer portion 121*a* may have a substantially rectangular shape, but the shape of the second heat transfer portion 121*a* is not limited thereto.

For example, the second heat transfer portion 121*a* may have a cross section gradually narrowing from the second heater 142*a* toward the second bent portion 122*a*. Or, the second heat transfer portion 121*a* may extend in a linear shape instead of the plate shape, and provided in plurality. That is, the second heat transfer portion 121*a* is sufficient to have a shape capable of transferring heat to the heating body 130*a*.

The second bent portion 122*a* may be bent toward the drain plug 200*a* from the second heat transfer portion 121*a*. The second bent portion 122*a* may be connected to the heating body 130*a*. As described below, the second bent portion 122*a* may be supported by the seating groove 221*a* of the drain plug 200*a*.

The heat conduction plate 100*a* may be formed of a material having high thermal conductivity. For example, the heat conduction plate 100*a* may include a material such as copper (Cu), aluminum (Al), or stainless steel (SUS).

The drain plug 200*a* may include a drain body 210*a*.

A sealing member accommodating groove 215*a* may be formed on an upper surface of the drain body 210*a*. More specifically, the sealing member accommodating groove 215*a* may be formed on an upper surface of a base connecting portion 211*a* of the drain body 210*a*. A sealing member 101*a* including a rubber material may be accommodated in the sealing member accommodating groove 215*a*. The sealing member 101*a* may be provided to seal a gap between the base and the drain plug 200*a*. The sealing member 101*a* may be provided in a shape corresponding to the opening portion of the base. The sealing member 101*a* may be provided in a shape having a ratio same as a ratio of a shape of the opening portion of the base and may be provided slightly larger than the opening portion of the base to secure an airtightness.

The drain plug 200*a* may include an extension rib 220*a* extending upward from the drain body 210*a*, penetrating the base, and disposed inside the base.

The extension rib 220*a* may extend toward the heat conduction plate 100*a* to support the first support flange

110*a* and the second support flange 120*a* of the heat conduction plate 100*a* from below.

A seating groove 221*a* may be formed on the upper surface of the extension rib 220*a*. A portion of the heat conduction plate 100*a* may be seated in the seating groove 221*a* of the extension rib 220*a*. The extension ribs 220*a* may be formed to face each other at both sides of the drain plug 200*a*.

The drain plug 200*a* may include a fixing rib 230*a* and a fixing hook 240*a*.

The fixing rib 230*a* may extend upward from the drain body 210*a*. The fixing rib 230*a* may be disposed between the extension ribs 220*a* facing each other. The fixing rib 230*a* may be connected to the extension rib 220*a*. The base may be inserted between the fixing rib 230*a* and the base connecting portion 211*a*.

The fixing hook 240*a* may extend downward from a hook support portion 241*a*. The hook support 241*a* may be provided on the opposite side of the fixing rib 230*a*. The hook support portion 241*a* may be connected between extension ribs 220*a* facing each other. The fixing hook 240*a* may extend from the hook support portion 241*a* on the opposite side of the fixing rib 230*a* and be supported by the inner surface of the base.

Figure 13:
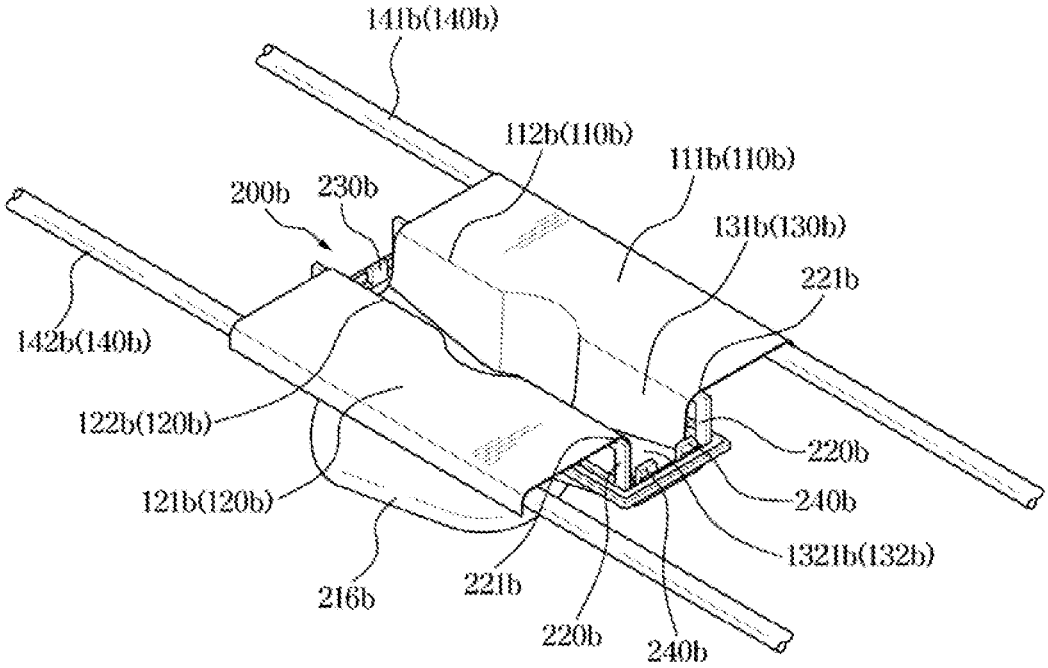
FIG. 13 shows some configurations of an outdoor unit of an air conditioner according to an embodiment of the disclosure.

FIG. 13 shows some configurations of an outdoor unit of an air conditioner according to an embodiment of the disclosure.

A partial configuration of an outdoor unit of an air conditioner according to an embodiment of the present disclosure will be described with reference to FIG. 13.

The outdoor unit of the air conditioner shown in FIG. 13 may include the same main components as the outdoor unit of the air conditioner shown in FIGS. 1 to 11. Components not described below may be provided with the same configuration as the outdoor unit of the air conditioner shown in FIGS. 1 to 11 and may include the same reference numerals.

Referring to FIG. 13, a first heater 141*b* and a second heater 142*b* may be installed at the base of the outdoor unit. An opening portion may be formed in a region between the first heater 141*b* and the second heater 142*b*. The opening portion may be formed by cutting a portion of the base.

The outdoor unit 1 may include a heat conduction plate 100*b* supported by the first heater 141*b* and the second heater 142*b*.

The heat conduction plate 100*b* may include a support flange. The support flange may include a first support flange 110*b* and a second support flange 120*b*.

The support flange may include a heating body 130*b* connected to the first support flange 110*b* and the second support flange 120*b*. The heating body 130*b* may extend from the support flange and be inserted into the drain plug 200*b*.

For example, the first support flange 110*b* and the second support flange 120*b* may be provided in symmetrical shapes at both ends of the heating body 130*b* and connected to the heating body 130*b*.

The first support flange 110*b* may be supported by being in contact with the first heater 141*b* and the drain plug 200*b*. An end portion of the first support flange 110*b* may be connected to the first heater 141*b* to cover a portion of the first heater 141*b*.

The first support flange 110*b* may include a first heat transfer portion 111*b* and a first bent portion 112*b*.

The first heat transfer portion 111*b* may be in contact with the first heater 141*b* to receive heat generated from the first heater 141*b*. For example, an end portion of the first heat transfer portion 111*b* may be in contact with the first heater 141*b*.

The first heat transfer portion 111*b* may be provided in a plate shape covering an area between the drain plug 200*b* and the first heater 141*b*. A shown in FIG. 13, the first heat transfer portion 111*b* may have a substantially rectangular shape, but the shape of the first heat transfer portion 111*b* is not limited thereto.

For example, the first heat transfer portion 111*b* may have a cross section gradually narrowing from the first heater 141*b* toward the first bent portion 112*b*. Or, the first heat transfer portion 111*b* may be extended in a linear shape instead of the plate shape and provided in plurality. That is, the first heat transfer portion 111*b* is sufficient to have a shape capable of transferring heat to the heating body 130*b*.

The first bent portion 112*b* may be bent toward the drain plug 200*b* from the first heat transfer portion 111*b*. The first bent portion 112*b* may be connected to the heating body 130*b*. As described below, the first bent portion 112*b* may be supported by a seating groove 221*b* of the drain plug 200*b*.

The first support flange 110*b* may be supported by being in contact with the first heater 141*b* and the drain plug 200*b*. The end portion of the first support flange 110*b* may be connected to the first heater 141*b* so as to cover a portion of the first heater 141*b*.

The second support flange 120*b* may include a second heat transfer portion 121*b* and a second bent portion 122*b*.

The second heat transfer portion 121*b* may be in contact with the second heater 142*b* to receive heat generated from the second heater 142*b*. For example, an end portion of the second heat transfer portion 121*b* may be in contact with the second heater 142*b*.

The second heat transfer portion 121*b* may be provided in a plate shape covering a region between the drain plug 200*b* and the second heater 142*b*. As shown in FIG. 13, the second heat transfer portion 121*b* may have a substantially rectangular shape, but the shape of the second heat transfer portion 121*b* is not limited thereto.

For example, the second heat transfer portion 121*b* may have a cross section gradually narrowing from the second heater 142*b* toward the second bent portion 122*b*. Or, the second heat transfer portion 121*b* may extend in a linear shape instead of the plate shape, and provided in plurality. That is, the second heat transfer portion 121*b* is sufficient to have a shape capable of transferring heat to the heating body 130*b*.

The second bent portion 122*b* may be bent toward the drain plug 200*b* from the second heat transfer portion 121*b*. The second bent portion 122*b* may be connected to the heating body 130*b*. As described below, the second bent portion 122*b* may be supported by the seating groove 221*b* of the drain plug 200*b*.

The heat conduction plate 100*b* may be formed of a material having high thermal conductivity. For example, the heat conduction plate 100*b* may include a material such as copper (Cu), aluminum (Al), or stainless steel (SUS).

The drain plug 200*b* may include a drain body 210*b*.

A sealing member accommodating groove 215*b* may be formed on an upper surface of the drain body 210*b*. More specifically, the sealing member accommodating groove 215*b* may be formed on an upper surface of a base connecting portion 211*b* of the drain body 210*b*. A sealing member 101*b* including a rubber material may be accommodated in the sealing member accommodating groove 215*b*. The sealing member 101*b* may be provided to seal a gap between the base and the drain plug 200*b*. The sealing member 101*b* may be provided in a shape corresponding to the opening of the base. The sealing member 101*b* may be provided in a shape having a ratio same as a ratio of a shape of the opening portion of the base and may be provided slightly larger than the opening portion of the base to secure an airtightness.

The drain plug 200*b* may include an extension rib 220*b* extending upward from the drain body 210*b*, penetrating the base, and disposed inside the base.

The extension rib 220*b* may extend toward the heat conduction plate 100*b* to support the first support flange 110*b* and the second support flange 120*b* of the heat conduction plate 100*b* from below.

A seating groove 221*b* may be formed on an upper surface of the extension rib 220*b*. A portion of the heat conduction plate 100*b* may be seated in the seating groove 221*b* of the extension rib 220*b*. The extension ribs 220*b* may be formed to face each other at both sides of the drain plug 200*b*.

A drain plug 200*b* of an outdoor unit of an air conditioner according to an embodiment of the disclosure shown in FIG. 13 may include a first fixing hook 230*b* and a second fixing hook 240*b*.

That is, in the drain plug 200*b* of the outdoor unit of the air conditioner according to an embodiment of the disclosure shown in FIG. 13, the configuration of the fixing ribs 230 and 230*a* may be omitted and both ends of the drain plug 200*b* may be provided symmetrically, unlike the drain plug 200 of the outdoor unit of the air conditioner according to an embodiment of the disclosure shown in FIGS. 6 and 7, and the drain plug 200*a* of the outdoor unit of the air conditioner according to an embodiment of the disclosure shown in FIG. 12

The first fixing hook 230*b* may extend upward from the base connecting portion 211*b*. The second fixing hook 240*b* may extend upward from the base connecting portion 211*b*. The first fixing hook 230*b* and the second fixing hook 240*b* may be symmetrically formed by being disposed to face each other with respect to the center of the drain plug 200*b*.

For example, the first fixing hooks 230*b* may be provided in two to correspond to the number of the second fixing hooks 240*b*. However, the number of the first fixing hook 230*b* and the second fixing hook 240*b* is not limited thereto and may be provided with one or more.

The first fixing hook 230*b* may have an upper thickness and a lower thickness different from each other. Accordingly, the upper portion of the first fixing hook 230*b* may be supported by the inner surface of the base.

The second fixing hook 240*b* may have an upper thickness and a lower thickness different from each other. Accordingly, the upper portion of the second fixing hook 240*b* may be supported by the inner surface of the base.

The first fixing hook 230*b* and the second fixing hook 240*b* may be provided to be elastically deformable. Accordingly, the drain plug 200*b* may be fixed to the base by press-fitting the drain plug 200*b* into the base.

In addition, the shapes of the first fixing hook 230*b* and the second fixing hook 240*b* are not limited thereto, and may extend from the upper portion to the lower portion of the drain plug 200*b* as shown in FIG. 12. Even in this case, the first fixing hook 230*b* and the second fixing hook 240*b* may be provided in a shape symmetrical to each other with respect to the center of the drain plug 200*b*.

By inserting a heat conduction plate connected to the heater into the inside of the drain plug, it is possible to prevent freezing of the drain hole and its surroundings.

By forming an auxiliary drain portion smaller in diameter than the drain hole inside the drain hole, it is possible to prevent rodents or insects from entering the outdoor unit.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. An outdoor unit of an air conditioner, the outdoor unit comprising:
- a housing including a base forming a bottom surface of the outdoor unit;
- a fan inside the housing to cause air to flow;
- a heat exchanger inside the housing to perform heat-exchange with the air caused to flow by the fan;
- a heater on the base;
- a drain plug mounted on, and penetrating, the base, spaced apart from the heater, and forming a drain hole; and
- a heat conduction plate including:
  - a support flange supported on, and in contact with, the heater; and
  - a heating body extending from the support flange and inserted into the drain plug,
  - so that the heat conduction plate transfers heat generated by the heater to inside of the drain plug,
  - wherein the heating body includes an auxiliary drain portion accommodated in the drain hole so that water inside the housing is dischargeable through the auxiliary drain portion and the drain hole to outside of the housing.

2. The outdoor unit of claim 1, wherein the support flange includes:
- a heat transfer portion in contact with the heater to receive heat generated by the heater; and
- a bent portion bent toward the drain plug from the heat transfer portion and connected to the heating body.

3. The outdoor unit of claim 2, wherein the heating body includes:
- an insertion portion extending downward from the bent portion and disposed inside of the drain plug; and
- a heating portion connected to the insertion portion,
- wherein the auxiliary drain portion extends downward from the heating portion.

4. The outdoor unit of claim 3, wherein the heating portion is inclined downward toward the auxiliary drain portion.

5. The outdoor unit of claim 1, wherein the auxiliary drain portion is smaller than the drain hole, and the auxiliary drain portion has a diameter less than 12 mm.

6. The outdoor unit of claim 1, wherein the drain plug includes:
- a drain body outside the base and including the drain hole; and
- an extension rib extending upward from the drain body, and penetrating the base.

7. The outdoor unit of claim 6, wherein the extension rib includes:
- a seating groove on an upper surface of the extension rib so that a portion of the heat conduction plate is seated in the seating groove.

8. The outdoor unit of claim 6, wherein the drain plug includes:
- a fixing rib extending from the drain body to form a base accommodating groove into which the base is accommodated; and
- a fixing hook extending from the drain body and supported on an inner surface of the base.

9. The outdoor unit of claim 6, wherein the drain body includes:

a base connecting portion forming an upper surface of the drain body in contact with the base; and a drain guide portion inclined downward from the base connecting portion toward the drain hole.

10. The outdoor unit of claim 9, wherein the drain guide portion is spaced apart from the heat conduction plate to form a drainage space.

11. The outdoor unit of claim 6, wherein the drain body includes:

a sealing member accommodating groove on an upper surface of the drain body; and a sealing member, accommodated in the sealing member accommodating groove, and sealing between the base and the drain plug.

12. The outdoor unit of claim 1, wherein the heater is provided as a pair of heaters, and the drain hole is formed in a region between the heaters of the pair of heaters.

13. The outdoor unit of claim 1, wherein the heat conduction plate is inside of the drain plug and spaced apart from the drain plug.

14. The outdoor unit of claim 1, wherein the heat conduction plate and the drain plug are formed of different materials.

* * * * *